US006896198B2

(12) United States Patent
Koch-Groeber et al.

(10) Patent No.: US 6,896,198 B2
(45) Date of Patent: May 24, 2005

(54) INJECTOR, IN PARTICULAR FOR COMMON RAIL INJECTION SYSTEMS OF DIESEL ENGINES

(75) Inventors: Hermann Koch-Groeber, Stuttgart (DE); Uemit Canlioglu, Ditzingen-Hirschlanden (TR); Thilo Klam, Gerlingen (DE); Andreas Gaudl, Remshalden (DE); Stefan Schuster, Stuttgart (DE); Christoffer Uhr, Bruchsal (DE); Andreas Rettich, Herrenberg (DE); Wolfgang Fleiner, Stuttgart (DE); Markus Rueckle, Stuttgart (DE)

(73) Assignee: Robert Bosch GmbH, Stuttgart (DE)

Subject to any disclaimer, the term of this patent is extended or adjusted under 35 U.S.C. 154(b) by 207 days.

(21) Appl. No.: 10/314,345

(22) Filed: Dec. 9, 2002

(65) Prior Publication Data

US 2003/0106947 A1 Jun. 12, 2003

(30) Foreign Application Priority Data

Dec. 7, 2001 (DE) ..... 101 60 262

(51) Int. Cl.[7] ..... F02M 41/16; F02M 59/00; B05B 1/30

(52) U.S. Cl. ..... 239/96; 239/88; 239/533.2; 239/533.3; 239/585.1; 239/585.5

(58) Field of Search ..... 239/96, 88–93, 239/533.2, 533.3, 533.12, 585.1, 585.3, 585.4, 585.5, 533.8, 533.9; 251/129.15, 129.21, 127

(56) References Cited

U.S. PATENT DOCUMENTS

| | | | | |
|---|---|---|---|---|
| 4,129,255 A | * | 12/1978 | Bader et al. | 239/96 |
| 4,545,352 A | * | 10/1985 | Jourde et al. | 123/447 |
| 5,265,804 A | * | 11/1993 | Brunel | 239/88 |
| 5,779,149 A | * | 7/1998 | Hayes, Jr. | 239/124 |
| 6,027,047 A | * | 2/2000 | Augustin | 239/533.3 |

FOREIGN PATENT DOCUMENTS

| | | |
|---|---|---|
| DE | 41 15 103 A1 | 4/1992 |
| DE | 198 26 179 A | 5/2000 |
| EP | 0 789 142 A1 | 8/1997 |
| EP | 0 829 641 A2 | 3/1998 |

* cited by examiner

*Primary Examiner*—Davis Hwu
(74) *Attorney, Agent, or Firm*—Ronald E. Greigg

(57) ABSTRACT

An injector, especially for common rail injection systems of Diesel engines, has a nozzle needle, a control piston for actuating the nozzle needle, a valve that actuates the control piston and that is triggered by via an outlet throttle and an inlet throttle, and a hydraulic stop for the control piston, such that the flow from the inlet throttle to the outlet throttle at the narrowest cross section can additionally be throttled. The control piston is embodied conically on its offset top side oriented toward the outlet throttle or the inlet throttle.

14 Claims, 1 Drawing Sheet

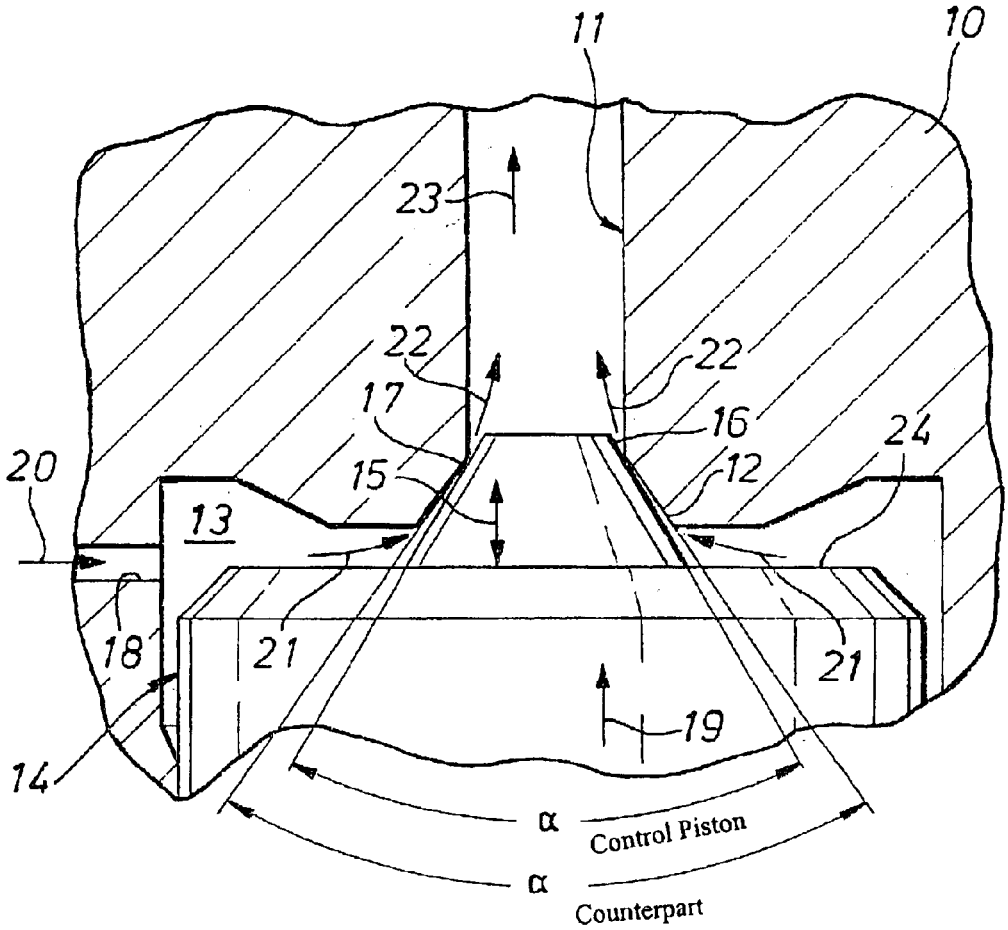
11
10
23
22
22
17
16
24
20
15
12
13
18
21
21
19
14
α
Control Piston
α
Counterpart

INJECTOR, IN PARTICULAR FOR COMMON RAIL INJECTION SYSTEMS OF DIESEL ENGINES

BACKGROUND OF THE INVENTION

1. Field of the Invention

The invention relates to an improved fuel injector for use in a common rail fuel injection system.

2. Description of the Prior Art

In injectors, especially those for common rail injection systems of Diesel engines, the opening of the nozzle needle required for the injection is achieved by means of a servo valve. An actuator, such as a magnet valve or piezoelectric element, opens a valve and lowers the pressure in a control chamber via a so-called outlet throttle. The control chamber is defined by the control piston, which acts on the nozzle needle. The lowered pressure in the control chamber on the effective surface area of the control piston alters the force equilibrium at the control piston and sets the control piston into motion, if the pressure falls below a threshold value. If the valve is closed by the actuator, then an increase in pressure occurs in the control chamber, because fuel is supplied to the control chamber via a so-called inlet throttle from an external pressure supply, such as a common rail reservoir. Because of the pressure increase, the control pistons move in the opposite direction. Relative to the location of the control piston, the outlet throttle is typically placed centrally while the inlet throttle is placed outward from it.

In the opened state of the valve, a pressure is established in the control chamber, whose reduction relative to the pressure of the power supply is determined essentially by the current or instantaneous flows through the outlet throttle and inlet throttle. If the valve is open for a long enough time, the control piston reaches a stop, which may be embodied as a mechanical or hydraulic stop. An injector with a mechanical control piston stop (fixed stop) is shown for instance in European Patent Disclosure EP 0 548 916. However, an injector of this kind is not the subject of the present invention.

An injector with a hydraulic control piston stop has become known from European Patent Disclosure EP 0 661 442. This is the prior art that is the point of departure for the present invention. The mode of operation of a hydraulic stop is such that the control piston, as a result of its altered position, additionally throttles the current flow from the inlet throttle to the outlet throttle. This creates an increased pressure upstream of the additional throttle at the narrowest cross section. The narrowest cross section is conventionally called an "N throttle". The increased pressure acts on a large part of the area of the control piston with a force that acts counter to an opening of the valve piston. The control piston assumes such a position, and thus determines the opening of the N throttle in such a way that the two pressure forces, along with the other forces on the control piston, put the control piston in a position of equilibrium.

The known hydraulic control piston stop of EP 0 661 442 has the disadvantage that periodic motions of the control piston about the position of the hydraulic stop occur, which cause oscillations of the entire system of the hydraulic stop, which can be either self-excited or externally excited. Because of the oscillations of the hydraulic stop, the nozzle needle oscillates as well, and thus the injection rate also fluctuates. The oscillations are expressed as an undulating course of the injection quantity of the injector, as a function of the trigger time of the actuator.

It is true that the attempt has already been made to reduce the oscillation amplitudes by minimizing the control chamber volume. However, recent developments have shown that this provision is inadequate, and it has structural limits, for instance because the relative tolerance in the volume increases upon minimization, which has adverse consequences for the injection quantity tolerances. Moreover, as the system pressure increases, which is favorable for the engine function, the tendency to oscillation also increases.

OBJECT AND SUMMARY OF THE INVENTION

The object of the invention is to minimize the amplitudes of the described oscillations in the system of the hydraulic stop in such a way that they no longer have an adverse effect on the injection event and can thus be considered negligible.

Although it is indeed known per se from EP 0 548 916 (already mentioned above), which is of a different generic type, to provide the control piston with a conical top side this reference—in contrast to the present invention—pertains to a fixed stop. The pairing of two cones (on the one hand of the control piston and on the other of the counterpart element), as disclosed by EP 0 548 916, in fact serves a completely different purpose from that of the present invention: The sole object of the cones is to define the diameter of the fixed stop. This diameter must be considerably smaller than the diameter of the control piston itself, because otherwise the closing event would be needlesly slowed down.

The nucleus of the invention is accordingly the design of the narrowest cross section by means of a cone on the top side of the control piston, and the embodiment of the geometry in the counterpart element, such that—given an outlet throttle located centrally to the control piston and an inlet throttle located outward from it—the N throttle results at a diameter that is as small as possible. In that case, the counterpart element should have a larger cone angle than the control piston.

As an alternative to this, however, the inlet throttle can also be disposed centrally to the control piston while the outlet throttle is located outward from it. In that case, the N throttle should be located at the largest possible diameter, which can be achieved by providing that the cone angle of the counterpart element is smaller than the cone angle of the control piston.

BRIEF DESCRIPTION OF THE DRAWING

The invention will be better understood and further objects and advantages thereof will become more apparent from the ensuing detailed description of a preferred embodiment taken in conjunction with the sole drawing FIGURE which is a vertical section, highly enlarged, of a detail of a servo valve for injectors, with one embodiment of a hydraulic stop.

DESCRIPTION OF THE PREFERRED EMBODIMENT

Reference numeral 10 designates a valve housing with a bore 11, which functions as a so-called outlet throttle. The outlet throttle 11 is widened conically on the lower end—at 12—where it discharges into a control chamber 13.

A control piston 14 is disposed coaxially to the outlet throttle 11 in the valve housing 10 such that it is movable in the direction of the arrow 15, that is, axially. The offset end 16 of the control piston 14 oriented toward the outlet throttle 11 (the upper end in the drawing) is embodied frustoconically and cooperates with the conical enlargement 12 of the outlet throttle 11. The result is a narrowest flow cross section from the control chamber 13 to the outlet throttle 11; this narrowest cross section is identified by the numeral 17 and will be called an "N throttle".

Fuel is delivered to the control chamber 13 through a bore 18 of comparatively slight diameter that enters at the side and that communicates with a suitable pressure supply, such as a pressure reservoir (or so-called common rail). The bore 18 is called an inlet throttle. In the exemplary embodiment shown, it is disposed farther out relative to the outlet throttle 11 and the control piston 14.

The conical part 16 of the control piston 14 forms a hydraulic stop, which cooperates with the conical counterpart element 12 of the outlet throttle 11 that acts as a counterpart stop. In the exemplary embodiment shown, the cone angle of the counterpart element, that is, $\alpha_{counter\ part}$, is 60°. (However, this value must be understood as merely an example. In principle, a cone angle of 120° would also be conceivable for the counterpart element.) The drawing clearly shows that the cone angle of the control piston 14, that is, $\alpha_{control\ piston}$, is dimensioned as still somewhat smaller than $\alpha_{counter\ part}$. As a result of the geometrical relationships that can be seen from the drawing, what is obtained—advantageously—is a very slight increase in the cross section of the N throttle 17 as a function of the stroke of the control piston 14. The disposition visible in the drawing and described above functions as follows. In the opened state of the servo valve, a pressure is established in the control chamber 13 that is lower—dictated by the throttle cross sections of the outlet throttle 11 and the inlet throttle 18—than the pressure of the power supply (such as a common rail reservoir) that acts on the back side (not shown in the drawing) of the control piston 14. As a consequence of this pressure difference, the control piston 14 moves in the direction of the arrow 19. If the servo valve remains open for long enough, the control piston 14 finally reaches the (upper) stop position shown in the drawing. Calling this a hydraulic stop is meant to express the fact that the control piston 14, as a result of its altered position, additionally throttles the current flow from the inlet throttle 18 to the outlet throttle 11 (see the arrows 20–23). The result is an increased pressure upstream of the outlet throttle 11 at the narrowest cross section (N throttle 17). This increased pressure acts on a large part of the end face 24 of the control piston 14 with a force that acts counter to an opening motion of the valve piston (not shown). The control piston 14 thus assumes a position in which it determines the opening of the N throttle 17 in such a way that the two pressure forces acting on the control piston 14, together with the external forces on the control piston 14, are in equilibrium.

The foregoing relates to a preferred exemplary embodiment of the invention, it being understood that other variants and embodiments thereof are possible within the spirit and scope of the invention, the latter being defined by the appended claims.

We claim:

1. An injector for common rail injection systems of Diesel engines, comprising a nozzle needle, a control piston (14) for actuating the nozzle needle, a valve that actuates the control piston (14) and is triggered by a magnet valve or niezoelectric actuator element via an outlet throttle (11) and an inlet throttle (18), and a hydraulic stop (16) for the control piston (14), such that the flow from the inlet throttle (18) to the outlet throttle (11) can additionally be throttled at the narrowest cross section (17), the control piston (14) being embodied conically on its offset top side (16) oriented toward the outlet throttle (11) or the inlet throttle, wherein the counterpart outlet throttle (11) or inlet throttle (18) that cooperates with the control piston (14) is also embodied conically and coaxially with the control piston (14), but with a different cone angle ($\alpha$).

2. The injector according to claim 1, further comprising a centrally disposed outlet throttle (11) and an outer inlet throttle (18), characterized in that the cone angle $\alpha$ of the outlet throttle (11) is greater than the cone angle $\alpha$ of the control piston (14).

3. The injector according to claim 2, wherein the cone angles ($\alpha$) of the control piston (14) and of the outlet throttle and inlet throttle (11 and 18) are acute angles.

4. The injector according to claim 3, wherein the cone angle $\alpha$ of the control piston (14) is smaller than or at most equal to 60°.

5. The injector according to claim 2, wherein the conical part (16) of the control piston (14) is a truncated cone.

6. The injector according to claim 1, comprising a centrally disposed inlet throttle and an outer outlet throttle, characterized in that the cone angle of the counterpart element is smaller than the cone angle $\alpha$ of the control piston (14).

7. The injector according to claim 6, wherein the cone angles ($\alpha$) of the control piston (14) and of the outlet throttle and inlet throttle (11 and 18) are acute angles.

8. The injector according to claim 7, wherein the cone angle $\alpha$ of the control piston (14) is smaller than or at most equal to 60°.

9. The injector according to claim 6, wherein the conical part (16) of the control piston (14) is a truncated cone.

10. The injector according to claim 1, wherein the cone angles ($\alpha$) of the control piston (14) and of the outlet throttle and inlet throttle (11 and 18) are acute angles.

11. The injector according to claim 10, wherein the cone angle $\alpha$ of the control piston (14) is smaller than or at most equal to 60°.

12. The injector according to claim 1, wherein the cone angle $\alpha$ of the control piston (14) is smaller than or at most equal to 60°.

13. The injector according to claim 12, wherein the conical part (16) of the control piston (14) is a truncated cone.

14. The injector according to claim 1, wherein the conical part (16) of the control piston (14) is a truncated cone.

* * * * *